US007296394B2

(12) United States Patent
Clough et al.

(10) Patent No.: US 7,296,394 B2
(45) **Date of Patent: *Nov. 20, 2007**

(54) FLUOROPOLYMER FIBER COMPOSITE BUNDLE

(75) Inventors: Norman Ernest Clough, Landenberg, PA (US); David Isaac Lutz, Newark, DE (US); Gary Harp, Newark, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/246,861

(22) Filed: Oct. 6, 2005

(65) Prior Publication Data

US 2006/0179812 A1 Aug. 17, 2006

Related U.S. Application Data

(63) Continuation-in-part of application No. 11/056,074, filed on Feb. 11, 2005, now abandoned.

(51) Int. Cl.
*D02G 3/02* (2006.01)

(52) U.S. Cl. ..... 57/210

(58) Field of Classification Search ..... 57/210, 57/211, 231, 237

See application file for complete search history.

(56) References Cited

U.S. PATENT DOCUMENTS

| | | | | |
|---|---|---|---|---|
| 3,758,704 | A | 9/1973 | Naud | 174/102 E |
| 3,844,195 | A | 10/1974 | Rhodes | 87/1 |
| 3,882,667 | A | 5/1975 | Barry | 57/157 |
| 4,074,512 | A | 2/1978 | Matt | 57/140 |
| 4,375,779 | A | 3/1983 | Fischer | 87/6 |
| 4,624,097 | A | 11/1986 | Wilcox | 57/232 |
| 4,776,851 | A | 10/1988 | Bruchman et al. | 623/13 |
| 4,898,046 | A | 2/1990 | Mancewicz et al. | 74/502 |
| 5,049,155 | A | 9/1991 | Bruchman et al. | 623/17 |
| 5,060,466 | A | 10/1991 | Matsuda et al. | 57/7 |
| 5,061,561 | A | 10/1991 | Katayama | 428/364 |
| 5,101,190 | A | 3/1992 | Bullock et al. | 338/214 |
| 5,197,983 | A | 3/1993 | Berman et al. | 623/13 |
| 5,258,040 | A | 11/1993 | Bruchman et al. | 623/66 |
| 5,296,292 | A | 3/1994 | Butters | 428/375 |
| 5,314,446 | A | 5/1994 | Hunter et al. | 606/231 |

(Continued)

FOREIGN PATENT DOCUMENTS

| | | | |
|---|---|---|---|
| CA | 1054465 | 5/1979 | 118/36 |

(Continued)

OTHER PUBLICATIONS

ASTM International, Standard Test Method for Wet and Dry Yarn-onYarn Abrasion Resistance, Current edition approval Nov. 10, 2000, Published Feb. 2001. Annual Book of ASTM Standards, vol. 07.01, pp. 1-8.

(Continued)

*Primary Examiner*—Shaun R. Hurley
(74) *Attorney, Agent, or Firm*—Allan M. Wheatcraft

(57) ABSTRACT

A rope comprising a plurality of bundle groups, each of said bundle groups having a periphery and comprising a plurality of high strength fibers, at least one low coefficient of friction fiber disposed around at least a portion of the periphery of at least one of the bundle groups.

10 Claims, 5 Drawing Sheets

U.S. PATENT DOCUMENTS

| | | | | |
|---|---|---|---|---|
| 5,456,983 | A | 10/1995 | Sassa | 428/370 |
| 5,562,987 | A | 10/1996 | Shimizu | 428/364 |
| 5,636,551 | A | 6/1997 | Davidson et al. | 74/502.5 |
| 5,669,214 | A | 9/1997 | Kopanakis | 57/218 |
| 5,692,530 | A | 12/1997 | Bible et al. | 132/321 |
| 5,706,382 | A | 1/1998 | Smith | 385/102 |
| 5,802,828 | A | 9/1998 | Adorno | 57/232 |
| 5,920,671 | A | 7/1999 | Smith | 385/102 |
| 6,010,788 | A | 1/2000 | Kebabjian et al. | 428/381 |
| 6,020,276 | A * | 2/2000 | Hoyes et al. | 442/185 |
| 6,117,547 | A | 9/2000 | Kelmartin, Jr. et al. | 428/364 |
| 6,133,165 | A | 10/2000 | Tamaru et al. | 442/59 |
| 6,167,650 | B1 | 1/2001 | Duback | 43/44.98 |
| 6,424,768 | B1 | 7/2002 | Booth et al. | 385/102 |
| 6,479,143 | B1 | 11/2002 | Tamaru et al. | 428/364 |
| 6,528,709 | B2 | 3/2003 | Hebestreit et al. | 84/297 |
| 6,640,533 | B2 | 11/2003 | Bertini et al. | 57/210 |
| 6,724,282 | B2 | 4/2004 | Kao | 333/243 |
| 2002/0106956 | A1 | 8/2002 | Howland | 442/208 |
| 2003/0070413 | A1 | 4/2003 | Fujiwara et al. | 57/210 |
| 2003/0196676 | A1 | 10/2003 | Baillie | 132/321 |
| 2003/0226347 | A1 | 12/2003 | Smith et al. | 57/210 |
| 2004/0069132 | A1 | 4/2004 | Knudsen et al. | |
| 2004/0175567 | A1 | 9/2004 | Huang et al. | 428/393 |
| 2004/0194444 | A1 | 10/2004 | Vinod et al. | |
| 2006/0182962 | A1 * | 8/2006 | Bucher et al. | 428/364 |
| 2007/0062174 | A1 * | 3/2007 | Clough et al. | 57/212 |
| 2007/0079695 | A1 * | 4/2007 | Bucher et al. | 87/8 |

FOREIGN PATENT DOCUMENTS

| | | |
|---|---|---|
| WO | WO 03/064760 A2 | 8/2003 |

OTHER PUBLICATIONS

M. J. Neale, C8 Frictional properties of materials, Published 1973, Tribology Handbook.

* cited by examiner

FLUOROPOLYMER FIBER COMPOSITE BUNDLE

REFERENCE TO RELATED APPLICATION

The present application is a continuation-in-part application of U.S. patent application Ser. No. 11/056,074 filed Feb. 11, 2005 now abandoned.

FIELD OF THE INVENTION

The present invention relates to a fluoropolymer composite bundle and, more particularly, to ropes and other textiles made of composite bundles including fluoropolymers such as polytetrafluoroethylene (PTFE).

DEFINITION OF TERMS

As used in this application, the term "fiber" means a threadlike article as indicated at 16 and 18 of FIG. 1. Fiber as used herein includes monofilament fiber and multifilament fiber. A plurality of fibers may be combined to form a "bundle" 14 as shown in FIG. 1. When different types of fibers are combined to form a bundle, it is referred to herein as a "composite bundle." A plurality of bundles may be combined to form a "bundle group" 12 as shown in FIG. 1. A plurality of bundle groups may be combined to form a "rope" 10 as shown in FIG. 1 (although alternative rope constructions are contemplated and included in this invention as described herein).

"Repeated stress applications" as used herein means those applications in which fibers are subjected to tensile, bending, or torsional forces, or combinations thereof, that result in abrasion and/or compression failures of the fiber, such as in ropes for mooring and heavy lifting applications, including, for instance, oceanographic, marine, and offshore drilling applications, and in ropes which are bent under tension against a pulley, drum, or sheave.

"High strength fiber" as used herein refers to a fiber having a tenacity of greater than 15 g/d.

"Abrasion rate" as used herein means the quotient of the decrease in the break force of a sample and the number of abrasion test cycles (as further defined in Example 1).

"Ratio of break strengths after abrasion test" as used herein means the quotient of the break strength after the abrasion test for a given test article that includes the addition of fluoropolymer fibers and the break strength after the abrasion test for the same construction of the test article without the addition of the fluoropolymer fibers.

"Low density" as used herein means density less than about 1 g/cc.

"Persistence" is defined as the ability to remain effectively in position during use.

"D:d" as used herein means sheave diameter divided by the rope diameter.

"Low coefficient of friction fiber" as used herein means a polymeric material having a coefficient of friction equal to or less than that of dry polypropylene on steel.

BACKGROUND OF THE INVENTION

High-strength fibers are used in many applications. For example, polymeric ropes are widely used in mooring and heavy lifting applications, including, for instance, oceanographic, marine, and offshore drilling applications. They are subjected to high tensile and bending stresses in use as well as a wide range of environmental challenges. These ropes are constructed in a variety of ways from various fiber types. For example, the ropes may be braided ropes, wire-lay ropes, or parallel strand ropes. Braided ropes are formed by braiding or plaiting bundle groups together as opposed to twisting them together. Wire-lay ropes are made in a similar manner as wire ropes, where each layer of twisted bundles is generally wound (laid) in the same direction about the center axis. Parallel strand ropes are an assemblage of bundle groups held together by a braided or extruded jacket.

Component fibers in ropes used in mooring and heavy lifting applications include high modulus and high strength fibers such as ultra high molecular weight polyethylene (UHMWPE) fibers. DYNEEMA® and SPECTRA® brand fibers are examples of such fibers. Liquid crystal polymer (LCP) fibers such as liquid crystal aromatic polyester sold under the tradename VECTRAN® are also used to construct such ropes. Para-aramid fibers, such as Kevlar® fiber, likewise, also have utility in such applications.

The service life of these ropes is compromised by one or more of three mechanisms. Fiber abrasion is one of the mechanisms. This abrasion could be fiber-to-fiber abrasion internally or external abrasion of the fibers against another object. The abrasion damages the fibers, thereby decreasing the life of the rope. LCP fibers are particularly susceptible to this failure mechanism. A second mechanism is another consequence of abrasion. As rope fibers abrade each other during use, such as when the rope is bent under tension against a pulley or drum, heat is generated. This internal heat severely weakens the fibers. The fibers are seen to exhibit accelerated elongation rates or to break (i.e., creep rupture) under load. The UHMWPE fibers suffer from this mode of failure. Another mechanism is a consequence of compression of the rope or parts of the rope where the rope is pulled taught over a pulley, drum, or other object.

Various solutions to address these problems have been explored. These attempts typically involve fiber material changes or construction changes. The use of new and stronger fibers is often examined as a way to improve rope life. One solution involves the utilization of multiple types of fibers in new configurations. That is, two or more types of fibers are combined to create a rope. The different type fibers can be combined in a specific manner so as to compensate for the shortcoming of each fiber type. An example of where a combination of two or more fibers can provide property benefits are improved resistance to creep and creep rupture (unlike a 100% UHMWPE rope) and improved resistance to self-abrasion (unlike a 100% LCP rope). All such ropes, however, still perform inadequately in some applications, failing due to one or more of the three above-mentioned mechanisms.

Rope performance is determined to a large extent by the design of the most fundamental building block used to construct the rope, the bundle of fibers. This bundle may include different types of fibers. Improving bundle life generally improves the life of the rope. The bundles have value in applications less demanding than the heavy-duty ropes described above. Such applications include lifting, bundling, securing, and the like. Attempts have been made to combine fiber materials in such repeated stress applications. For example, UHMWPE fibers and high strength fibers, such as LCP fibers, have been blended to create a large diameter rope with better abrasion resistance, but they are still not as effective as desired.

The abrasion resistance of ropes for elevators has been improved by utilizing high modulus synthetic fibers, impregnating one or more of the bundles with polytetrafluoroethylene (PTFE) dispersion, or coating the fibers with PTFE powder. Typically such coatings wear off relatively quickly. Providing a jacket to the exterior of a rope or the individual bundles has also been shown to improve the rope life. Jackets add weight, bulk, and stiffness to the rope, however.

Fiberglass and PTFE have been commingled in order to extend the life of fiberglass fibers. These fibers have been woven into fabrics. The resultant articles possess superior flex life and abrasion resistance compared to fiberglass fibers alone. Heat-meltable fluorine-containing resins have been combined with fibers, in particular with cotton-like material fibers. The resultant fiber has been used to create improved fabrics. PTFE fibers have been used in combination with other fibers in dental floss and other low-load applications, but not in repeated stress applications described herein.

In sum, none of the known attempts to improve the life of ropes or cable have provided sufficient durability in applications involving both bending and high tension. The ideal solution would benefit both heavy-duty ropes and smaller diameter configurations, such as bundles.

SUMMARY OF THE INVENTION

The present invention provides a composite bundle for repeated stress applications comprising at least one high strength fiber, and at least one fluoropolymer fiber, wherein the fluoropolymer fiber is present in an amount of about 40% by weight or less.

In a preferred embodiment, the high strength fiber is liquid crystal polymer or ultrahigh molecular weight polyethylene, or combinations thereof.

Preferred weight percentages of the fluoropolymer fiber are about 35% by weight or less, about 30% by weight or less, about 25% by weight or less, about 20% by weight or less, about 15% by weight or less, about 10% by weight or less, and about 5% by weight or less.

Preferably, the composite bundle has a ratio of break strengths after abrasion test of at least 1.8, even more preferably of at least 3.8, and even more preferably of at least 4.0. Preferably, the fluoropolymer fiber is an ePTFE fiber, which may be a monofilament or multifilament, either of which can be low or high density.

In alternative embodiments, the fluoropolymer fiber comprises a filler such as molybdenum disulfide, graphite, or lubricant (hydrocarbon, or silicone base fluid).

In alternative embodiments, the high strength fiber is para-aramid, liquid crystal polyester, polybenzoxazole (PBO), high tenacity metal, high tenacity mineral, or carbon fiber.

In another aspect, the invention provides for a method of reducing abrasion- or friction-related wear of a fiber bundle in repeated stress applications while substantially maintaining the strength of the fiber bundle comprising the step of including in the fiber bundle at least one filament of fluoropolymer.

In other aspects, the invention provides a rope, belt, net, sling, cable, woven fabric, nonwoven fabric, or tubular textile made from the inventive composite bundle.

In still another aspect, this invention provides ropes comprising high strength fibers with significantly enhanced fatigue performance through the preferred positioning of low friction fibers at or near the surface of bundles or bundle groups in both lay and braid ropes. In this aspect, the invention provides a rope having a plurality of bundle groups, each of the bundle groups having a periphery and comprising a plurality of high strength fibers, the rope having at least one low coefficient of friction fiber disposed around at least a portion of the periphery of one of the bundle groups. Preferably, there are a plurality of low coefficient of friction fibers disposed around at least a portion of said periphery of the bundle groups. The low coefficient of friction fibers include fluoropolymers (preferably expanded PTFE), polyethylene, polypropylene polyethylenechlorotrifluorethylene, polytetrafluoroethylene, polychlorotrifluoroethylene, polyvinyl fluoride, polyvinylidene fluoride, polytrifluoroethylene, blends, and copolymers.

The invention also provides a bundle group for use in a rope having a periphery and a plurality of high strength fibers and at least one low coefficient of friction fiber disposed around at least a portion of the periphery of one of the bundle groups.

Finally, the invention also provides a method of making a rope having a plurality of bundle groups including the step of disposing around at least one of the bundle groups a low coefficient of friction fiber.

DETAILED DESCRIPTION OF THE INVENTION

Figure 1:
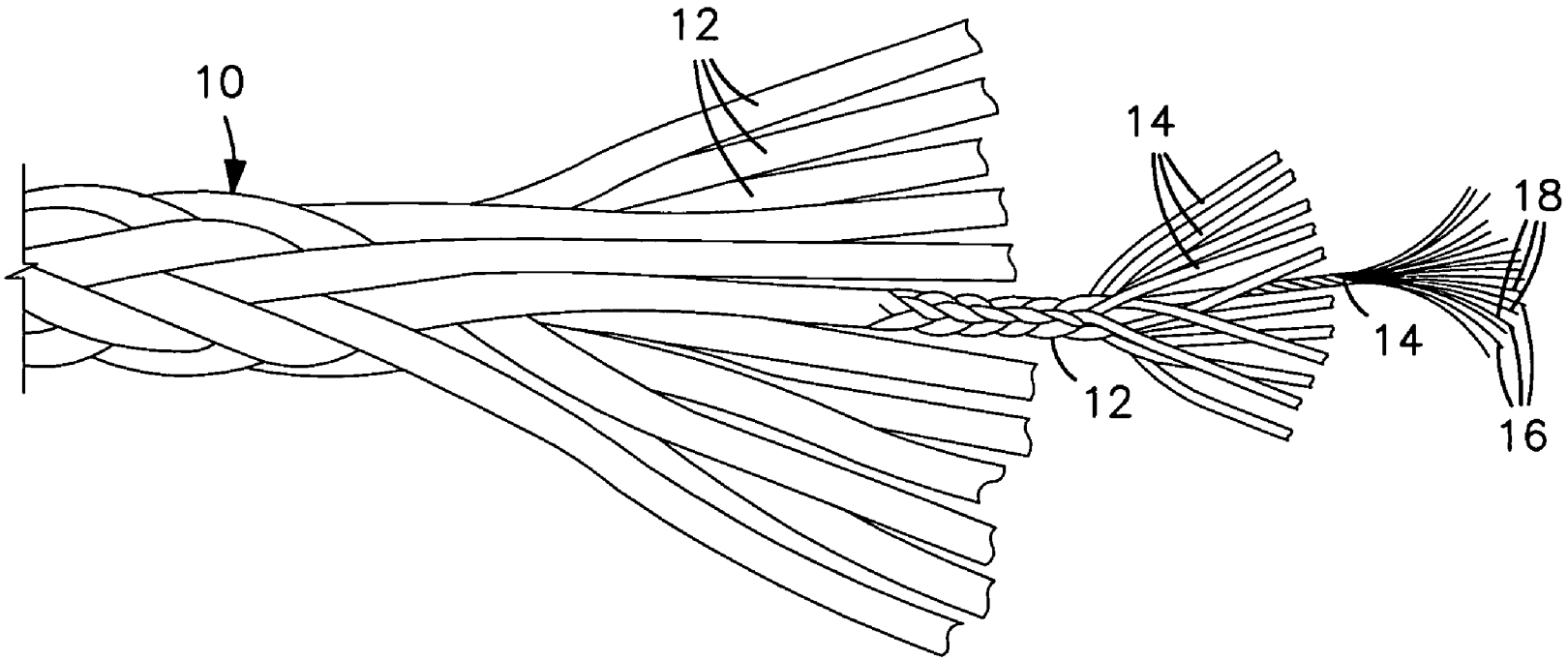
FIG. 1 is an exploded view of an exemplary embodiment of a rope made according to the present invention.

The inventors have discovered that a relatively small weight percent of a fluoropolymer fiber added to a bundle of high strength fibers produces a surprisingly dramatic increase in abrasion resistance and wear life.

The high-strength fibers used to form ropes, cables, and other tensile members for use in repeated stress applications include ultra high molecular weight polyethylene (UHMWPE) such as DYNEEMA® and SPECTRA® brand fibers, liquid crystal polymer (LCP) fibers such as those sold under the tradename VECTRAN®, other LCAPs, PBO, high performance aramid fibers, para-aramid fibers such as Kevlar® fiber, carbon fiber, nylon, and steel. Combinations of such fibers are also included, such as UHMWPE and LCP, which is typically used for ropes in oceanographic and other heavy lifting applications.

The fluoropolymer fibers used in combination with any of the above fibers according to preferred embodiments of the present invention include, but are not limited to, polytetrafluoroethylene (PTFE) (including expanded PTFE (ePTFE) and modified PTFE), fluorinated ethylenepropylene (FEP), ethylene-chlorotrif-luoroethylene (ECTFE), ethylene-tetrafluoroethylene (ETFE), or perfluoroalkoxy polymer (PFA). The fluoropolymer fibers include monofilament fibers, multifilament fibers, or both. Both high and low density fluoropolymer fibers may be used in this invention.

Although the fluoropolymer fiber typically has less strength than the high-strength fiber, the overall strength of the combined bundle is not significantly compromised by the addition of the fluoropolymer fiber or fibers (or replacement of the high strength fibers with the fluoropolymer fiber or fibers). Preferably, less than 10% strength reduction is observed after inclusion of the fluoropolymer fibers.

The fluoropolymer fibers are preferably combined with the high-strength fibers in an amount such that less than about 40% by weight of fluoropolymer fiber are present in the composite bundle. More preferable ranges include less than about 35% less than about 30%, less than about 25%, less than about 20%, less than about 15%, less than about 10%, less than about 5%, and about 1%.

Surprisingly, even at these low addition levels, and with only a moderate (less than about 10%) reduction in strength, the composite bundles of the present invention show a dramatic increase in abrasion resistance and thus in wear life. In some cases, the ratio of break strengths after abrasion tests has exceeded 4.0, as illustrated by the examples presented below (See Table 3). Specifically, as demonstrated in Examples 1-4 below, the break force of a fiber bundle including PTFE and a high-strength fiber after a given number of abrasion testing cycles are dramatically higher than that of the high-strength fiber alone. The abrasion rates, therefore, are lower for PTFE fiber-containing composite bundles than for the same constructions devoid of PTFE fibers.

Without being limited by theory, it is believed that it is the lubricity of the fluoropolymer fibers that results in the improved abrasion resistance of the composite bundles. In this aspect, the invention provides a method of lubricating a rope or fiber bundle by including a solid lubricous fiber to it.

The fluoropolymer fibers optionally include fillers. Solid lubricants such as graphite, waxes, or even fluid lubricants like hydrocarbon oils or silicone oils may be used. Such fillers impart additional favorable properties to the fluoropolymer fibers and ultimately to the rope itself. For example, PTFE filled with carbon has improved thermal conductivity and is useful to improve the heat resistance of the fiber and rope. This prevents or at least retards the build-up of heat in the rope, which is one of the contributing factors to rope failure. Graphite or other lubricious fillers may be used to enhance the lubrication benefits realized by adding the fluoropolymer fibers.

Any conventionally known method may be used to combine the fluoropolymer fibers with the high-strength fibers. No special processing is required. The fibers may be blended, twisted, braided, or simply co-processed together with no special combination processing. Typically the fibers are combined using conventional rope manufacturing processes known to those skilled in the art.

The inventors have also surprisingly found that not only does the addition of low friction polymer fibers to the synthetic rope greatly enhance fatigue life, but that the specific locations of low friction polymer fibers, tape and/or films within the rope can significantly impact the magnitude of this increase in fatigue life.

Although blending of fluoropolymer fibers within ropes without particular attention to specific positioning within the rope significantly enhances fatigue life, the present inventors have discovered that specific positioning of the fluoropolymers within the rope structure offers the ability to even further enhance life.

Figure 4:
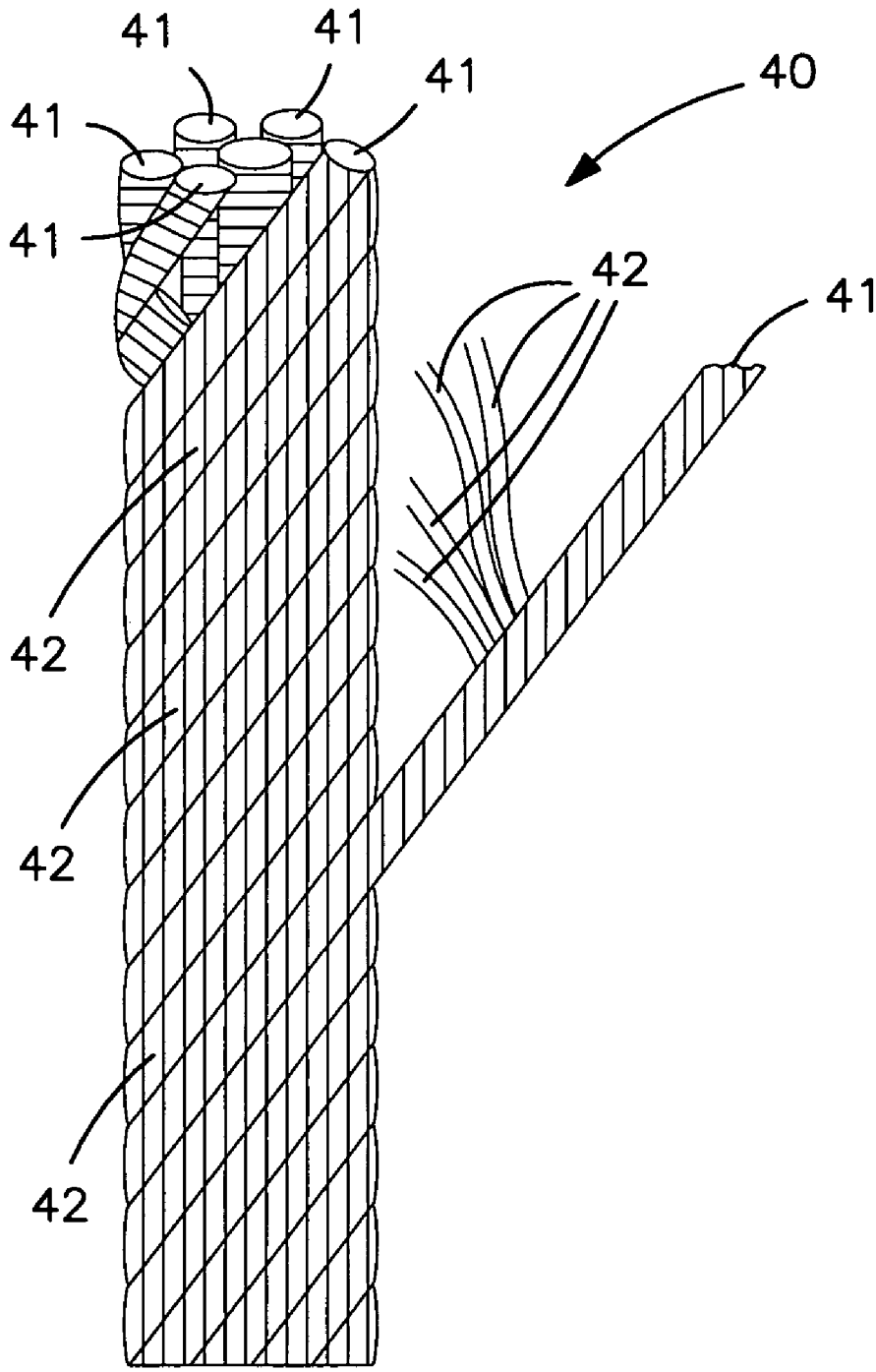
FIG. 4 is a perspective view of a rope made according to an exemplary embodiment of the present invention.
Figure 6:
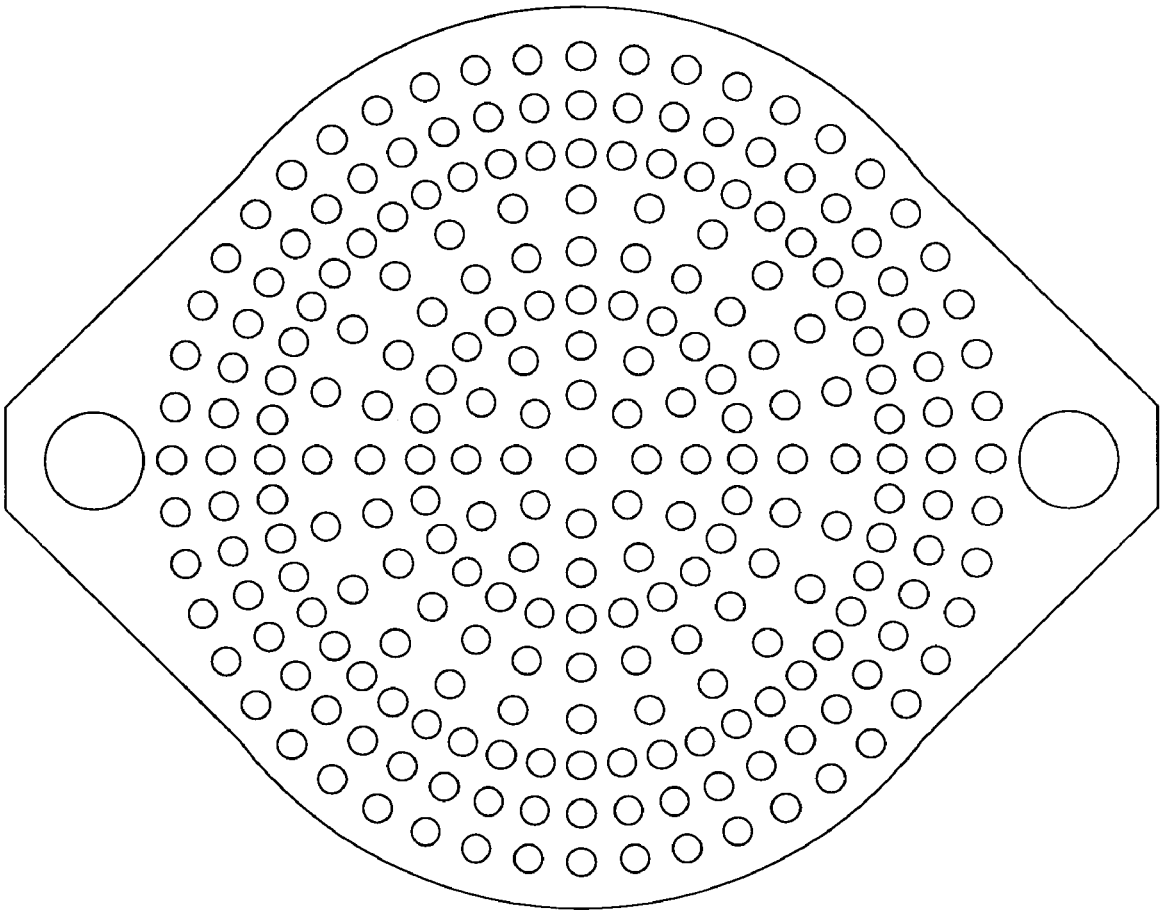
FIG. 6 is a front view of a Holly Board used to produce a rope according to an exemplary embodiment of the present invention.

With specific reference to FIG. 4, an exemplary embodiment of this aspect of the invention is illustrated. Rope 40 comprises a plurality of bundle groups 41, each formed of bundles of fibers. Each bundle group 41 is wrapped with a low coefficient of friction fiber 42, preferably expanded PTFE. Although each bundle group 41 is wrapped with a low coefficient of friction fiber 42 in the illustrated embodiment, any number of the bundle groups 41 could be so wrapped according to the invention, provided that at least one bundle group 41 is so wrapped. Alternatively, the bundles themselves may be wrapped with low coefficient of friction fiber 42. The inventive rope may be made, for example using a Holly Board such as that illustrated in FIG. 6 according to methods known in the art.

Although not wishing to be bound by theory, it appears that in enhancing fatigue life these low coefficient of friction fibers can work in a multiple of ways. This includes, but is not limited to, effectively providing a low friction wear resistant surface at key rope component interfaces, said low friction interfaces being key, while the form of the low friction material is less critical as long as the form provides persistence in the critical contact area.

The examples included herein show clearly that fluoropolymer fibers may be used to construct the low friction interface; however, other forms of fluoropolymers such as tape, film, and the like are also part of this invention. Other polymeric materials having a low coefficient of friction that are capable of being placed in the preferred positions and are capable of persistence are also contemplated as effective routes to enhanced fatigue performance. Suitable low friction polymers include, but are not limited to, hydrocarbon polymers, halogen containing polymers, fluorine containing polymers, polyethylene, polypropylene, polyethylenechlorotrifluorethylene, polytetrafluoroethylene, polychlorotrifluoroethylene, polyvinyl fluoride, polyvinylidene fluoride, polytrifluoroethylene, blends, and copolymers, with fluorinated polymers being preferred and polytetrafluoroethylene being most preferred. The strongest fiber versions of the above polymers, with strength typically being attained by orienting the polymer in the longitudinal fiber direction, may have effective persistence under high stress conditions and therefore providing the most enhanced fatigue performance. Examples of these stronger fiber materials can be found in gel spun polyethylene and expanded polytetrafluoroethylene. The low coefficient of friction fiber used herein is alternatively formed in a core-shell configuration, or is itself a composite material. It excludes woven materials however (i.e., the fiber is not part of a woven structure).

Although again not wishing to be bound by theory, the low friction materials placed at key areas can act to reduce, delay, or eliminate heat generation, reduce, delay, or eliminate abrasion damage and reduce, delay, or eliminate the loss of strength in high strength fibers and rope elements that may accompany heat and abrasion and shear stresses. Reduction, delay, or elimination of compressive and shear induced damage in those high strength fibers known to be sensitive, such as in aramid fibers, is also a contemplated effect of this invention.

Since the damaging effects of friction are a function of the magnitude of the normal stress of one bundle group against another, and since the low friction materials can also lead to adjustment of the shape of the bundle groups perpendicular to the normal stress such that the area of contact between the elements is increased, the normal stress is then decreased, and therefore the damaging effects of the friction are further mediated.

Preferred locations for these low friction materials are at interfaces between elements within the rope that are in contact with each other and move or slide relative to one another when the rope is stressed or bent.

These elements are defined in a hierarchical scheme within the rope structure starting at the fiber level where fibers may move relative to one another, the bundle level where bundles may move relative to one another, bundle group level where bundle groups may move relative to one another, and the rope itself, where the rope may move relative to itself in a crossover or relative to other ropes in a rope system.

Since the amount of this low friction fiber, tape and/or film required to enhance life is minimal with respect to the volume or mass of the rope, the low friction polymer need not have high strength or modulus such that it contribute a priori to initial rope strength, a restriction that in the past has limited the choice of rope component fibers to a selection from very high strength fibers. Surprisingly, fibers that are not considered high strength fibers may be used to improve fatigue performance. The low friction sliding elements, created through placement of the low friction polymers at key locations, are better able to share load such that the tensile strength of the rope is typically higher than one would expect with the replacement of some high strength components with low strength fibers and components.

Rope performance has historically been tuned with the use of coatings applied at the fiber, bundle, bundle group, or rope levels. Coatings formulated for abrasion resistance have been reported. Many of these coatings appear to reduce abrasion damage by acting as a lubricant, facilitating bending with less abrasion damage. These coatings are applied in liquid or powder form prior to, during, or after rope manufacture. Such coatings are expected to perform in concert with the subject invention, with the potential for significant enhancement of rope performance and life, especially in bending applications. The ropes of this invention are particularly useful in a deep sea hardware delivery systems.

EXAMPLES

In the examples presented below, abrasion resistance and wear life are tested on various fiber bundles. The results are indicative of the effects seen in ropes constructed from the bundles of the present invention, as will be appreciated by those skilled in the art.

Specifically, abrasion rate is used to demonstrate abrasion resistance. The wear life is demonstrated by certain examples in which the fiber bundles (with and without the inventive combination of fluoropolymer fibers) are cycled to failure. The results are reported as cycles to failure. More detail of the tests is provided below.

Testing Methods

Mass Per Unit Length and Tensile Strength Measurements

The weight per unit length of each individual fiber was determined by weighing a 9 m length sample of the fiber using a Denver Instruments. Inc. Model AA160 analytical balance and multiplying the mass, expressed in grams, by 1000 thereby expressing results in the units of denier. With the exception of Examples 6a and 6b, all tensile testing was conducted at ambient temperature on a tensile test machine (Zellweger USTER® TENSORAPID 4, Uster, Switzerland) equipped with pneumatic fiber grips, utilizing a gauge length of 350 mm and a cross-head speed of 330 mm/min. The strain rate, therefore, was 94.3%/min. For Examples 6a and 6b, tensile testing was conducted at ambient temperature on an INSTRON 5567 tensile test machine (Canton, Mass.) equipped with pneumatic horseshoe fiber grips, again utilizing a gauge length of 350 mm, a cross-head speed of 330 mm/min and, hence, a strain rate of 94.3%/min. The peak force, which refers to the break strength of the fiber, was recorded. Four samples were tested and their average break strength was calculated. The average tenacity of the individual fiber sample expressed in g/d was calculated by dividing the average break strength expressed in grams by the denier value of the individual fiber. In the case of testing composite bundles or bundle groups, the average tenacity of these samples was calculated by dividing the average break strength of the composite bundle or bundle group (in units of grams), by the weight per length value of the composite bundle or bundle group (expressed in units of denier). The denier value of the composite bundle or bundle group can be determined by measuring the mass of the sample or by summing the denier values of the individual components of the sample.

Density Measurement

Fiber density was determined using the following technique. The fiber volume was calculated from the average thickness and width values of a fixed length of fiber and the density calculated from the fiber volume and mass of the fiber. A 2-meter length of fiber was placed on an A&D FR-300 balance and the mass noted in grams (C). The thickness of the fiber sample was then measured at 3 points along the fiber using an AMES (Waltham, Mass., USA) Model LG3600 thickness gauge. The width of the fiber was also measured at 3 points along the same fiber sample using an LP-6 Profile Projector available from Ehrenreich Photo Optical Ind. Inc. Garden City, N.Y. Average values of thickness and width were then calculated and the volume of the fiber sample was determined (D). The density of the fiber sample was calculated as follows:

$$\text{fiber sample density (g/cc)} = C/D.$$

Abrasion Resistance Measurement

The abrasion test was adapted from ASTM Standard Test Method for Wet and Dry Yarn-on-Yarn Abrasion Resistance (Designation D 6611-00). This test method applies to the testing of yarns used in the construction of ropes, in particular, in ropes intended for use in marine environments.

Figure 2:
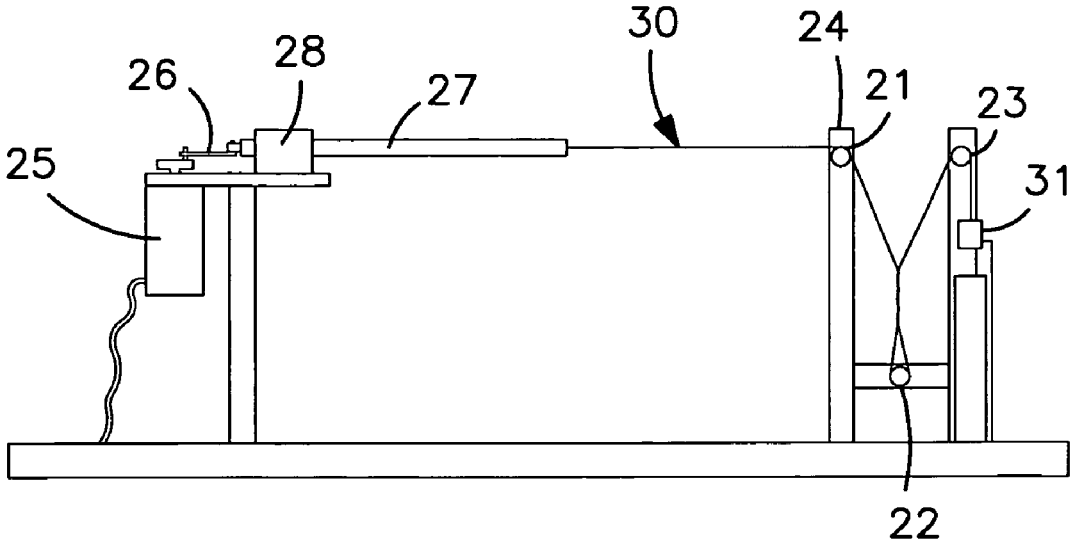
FIG. 2 is an illustration of an abrasion resistance test set-up.

The test apparatus is shown in FIG. 2 with three pulleys 21, 22, 23 arranged on a vertical frame 24. Pulleys 21, 22, 23 were 22.5 mm in diameter. The centerlines of upper pulleys 21, 23 were separated by a distance of 140 mm. The centerline of the lower pulley 22 was 254 mm below a horizontal line connecting the upper pulley 21, 23 centerlines. A motor 25 and crank 26 were positioned as indicated in FIG. 2. An extension rod 27 driven by the motor-driven crank 26 through a bushing 28 was employed to displace the test sample 30 a distance of 50.8 mm as the rod 27 moved forward and back during each cycle. A cycle comprised a forward and back stroke. A digital counter (not shown) recorded the number of cycles. The crank speed was adjustable within the range of 65 and 100 cycles per minute.

A weight 31 (in the form of a plastic container into which various weights could be added) was tied to one end of sample 30 in order to apply a prescribed tension corresponding to 1.5% of the average break strength of the test sample 30. The sample 30, while under no tension, was threaded over the third pulley 23, under the second pulley 22, and then over the first pulley 21, in accordance with FIG. 2. Tension was then applied to the sample 30 by hanging the weight 31 as shown in the figure. The other end of the sample 30 was then affixed to the extension rod 27 attached to the motor crank 26. The rod 27 had previously been positioned to the highest point of the stroke, thereby ensuring that the weight 31 providing the tension was positioned at the maximum height prior to testing. The maximum height was typically 6-8 cm below the centerline of the third pulley 23. Care was taken to ensure that the fiber sample 30 was securely attached to the extension rod 27 and weight 31 in order to prevent slippage during testing.

Figure 3:
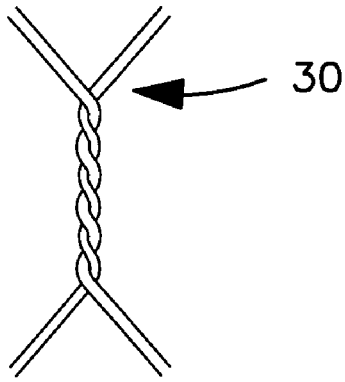
FIG. 3 is an illustration of a fiber sample twisted upon itself as used in the abrasion resistance test.

The test sample 30 while still under tension was then carefully removed from the second, lower, pulley 22. A cylinder (not shown) of approximately 27 mm diameter was placed in the cradle formed by the sample 30 and then turned 180° to the right in order to effect a half-wrap to the sample 30. The cylinder was turned an additional 180° to the right to complete a full 360° wrap. The twisting was continued in 180° increments until the desired number of wraps was achieved. The cylinder was then carefully removed while the sample 30 was still under tension and the sample 30 was replaced around the second pulley 22. By way of example, three complete wraps (3×360°) for a fiber sample 30 is shown in FIG. 3. The only deviation from the twist direction during wrapping would arise in the case of the sample being a twisted multifilament. In this case, the direction of this twist direction must be in the same direction as the inherent twist of the multifilament fiber.

In tests in which the test sample consists of two or more individual fibers, including at least one fiber of fluoropolymer, the following modified procedure was followed. After securing the test sample to the weight, the fluoropolymer fiber or fibers were placed side by side to the other fibers without twisting. Unless stated otherwise, the fluoropolymer fiber or fibers were always placed closest to the operator. The subsequent procedure for wrapping the fibers was otherwise identical to that outlined above.

Once the test setup was completed, the cycle counter was set to zero, the crank speed was adjusted to the desired speed, and the gear motor was started. After the desired number of cycles was completed, the gear motor was stopped and the abraded test sample was removed from the weight and the extension rod. Each test was performed four times.

The abraded test samples were then tensile tested for break strength and the results were averaged. The average tenacity was calculated using the average break strength value and the total weight per unit length value of the fiber or composite bundle sample.

In one example, the abrasion test continued until the fiber or composite bundle completely broke under the tension applied. The number of cycles were noted as the cycles to failure of the sample. In this example, three samples were tested and the average cycles to failure calculated.

Denier Test

The fiber denier was determined by weighing a 9 meter length sample of the fiber on a Denver Instruments. Inc. Model AA160 analytical balance and multiplying the mass which was expressed in grams, by 1000.

Fiber Tensile Test and Tenacity Calculation

Testing was conducted at ambient temperature on a tensile test machine (Zellweger USTER® TENSORAPID 4, Uster, Switzerland) equipped with pneumatic fiber grips, utilizing a gauge length of 350 mm and a cross-head speed of 330 mm/min. The peak force, which refers to the break strength of the fiber, was recorded. Four samples were tested and their average break strength was calculated. The average tenacity of the individual fiber sample expressed in g/d was calculated by dividing the average break strength expressed in grams by the denier value of the individual fiber.

Rope Tensile Test

Break strength tests for the laid control rope was conducted on a hydraulic tensile tester. Three samples were break tested using a 2.15 in/min extension rate after preconditioning the samples five times to 20,000 pounds at a continuous 2"/min crosshead rate. Sample gauge length was 128" inches in length. Samples were terminated with a splice. The reported break strength is the average for the three specimens.

Break strength of the braided rope samples was tested on a hydraulic tensile tester. Three samples of each rope were tested using a 10 in/min extension rate after cycling to half the breaking load 10 times for 10 seconds. Samples for break testing were fixed using 2 inch pins by a 13 inch lockstitch splice with buried tail and were on average 200 inches in length. The reported break strength is the average for the three specimens.

Density Measurement

Fiber density was determined using the following technique. The fiber volume was calculated from the average thickness and width values of a fixed length of fiber and the density calculated from the fiber volume and mass of the fiber. A 2 meter length of fiber was placed on an A&D FR-300 balance and the mass noted in grams (C). The thickness of the fiber sample was then measured at 3 points along the fiber using an AMES (Waltham, Mass., USA) Model LG3600 thickness gauge. The width of the fiber was also measured at 3 points along the same fiber sample using an LP-6 Profile Projector available from Ehrenreich Photo Optical Ind. Inc. Garden City, N.Y. Average values of thickness and width were then calculated and the volume of the fiber sample was determined (D). The density of the fiber sample was calculated as follows:

$$\text{Fiber sample density (g/cc)} = C/D.$$

Example 1

A single ePTFE fiber was combined with a single liquid crystal polymer (LCP) fiber (Vectran®, Celanese Acetate LLC, Charlotte, N.C.) and subjected to the afore-mentioned abrasion test. The results from this test were compared against the results from the test of a single LCP fiber.

An ePTFE monofilament fiber was obtained (HT400d Rastex® fiber, W.L. Gore and Associates, Inc., Elkton Md.). This fiber possessed the following properties: 425 d weight per unit length, 2.29 kg break force, 5.38 g/d tenacity and 1.78 g/cc density. The LCP fiber had a weight per unit length of 1567 d, a 34.55 kg break force, and a tenacity of 22.0 g/d.

The two fiber types were combined by simply holding them so that they were adjacent to one another. That is, no twisting or other means of entangling was applied. The weight percentages of these two fibers when combined were 79% LCP and 21% ePTFE. The weight per unit length of the composite bundle was 1992 d. The break force of the composite bundle was 33.87 kg. The tenacity of the composite bundle was 17.0 g/d. Adding the single ePTFE fiber to the LCP changed the weight per unit length, break force, and tenacity by +27%, −2%, and −23%, respectively. Note that the decrease in break force associated with the addition of the ePTFE monofilament fiber was attributed to the variability of the strength of the fibers.

These fiber properties, as well as those of all the fibers used in Examples 2 through 8, are presented in Table 1.

A single LCP fiber was tested for abrasion resistance following the procedure described previously. Five complete wraps were applied to the fiber. The test was conducted at 100 cycles per minute, under 518 g tension (which corresponded to 1.5% of the break force of the LCP fiber).

The composite bundle of the single LCP fiber and the ePTFE monofilament fiber was also tested for abrasion resistance in the same manner. Five complete wraps were applied to the composite bundle. The test was conducted at 100 cycles per minute and under 508 g tension (which corresponded to 1.5% of the break force of the fiber combination).

The abrasion tests were run for 1500 cycles, after which point the test samples were tensile tested to determine their break force. The composite bundle and the LCP fiber exhibited 26.38 kg and 13.21 kg break forces after abrasion, respectively. Adding the single PTFE monofilament fiber to the single LCP fiber increased the post-abrasion break force by 100%. Thus, adding the single ePTFE monofilament fiber changed the break force by −2% prior to testing and resulted in a 100% higher break force upon completion of the abrasion test.

Decrease in break force was calculated by the quotient of break strength at the end of the abrasion test and the initial break strength. Abrasion rate was calculated as the quotient of the decrease in the break force of the sample and the number of abrasion test cycles. The abrasion rates for the LCP fiber alone and the composite of the LCP fiber and ePTFE monofilament fiber were 14.2 g/cycle and 5.0 g/cycle, respectively.

The test conditions and test results for this example as well as those for all of the other examples (Examples 2 through 8) appear in Tables 2 and 3, respectively.

Example 2A

A single ePTFE monofilament fiber was combined with a single ultra high molecular weight polyethylene (UHMWPE) fiber (Dyneema® fiber, DSM, Geleen, the Netherlands). Abrasion testing was performed as previously described. The composite bundle test results were compared to the results from the test of a single UHMWPE fiber.

An ePTFE monofilament fiber as made and described in Example 1 was obtained. The two fiber types were combined by simply holding them so that they were adjacent to one another. That is, no twisting or other means of entangling was applied. The weight percentages of these two fibers when combined were 79% UHMWPE and 21% ePTFE. The weights per unit length of the UHMWPE and the composite bundle were 1581 d and 2006 d, respectively. The break forces of the UHMWPE and the composite bundle were 50.80 kg and 51.67 kg, respectively. The tenacities of the UHMWPE and the composite bundle were 32.1 g/d and 25.7 g/d, respectively. Adding the ePTFE fiber to the UHMWPE fiber changed the weight per unit length, break force, and tenacity by +27%, +2%, and −20%, respectively.

A single UHMWPE fiber was tested for abrasion resistance following the procedure described previously. Three complete wraps were applied to the fiber. The test was conducted at 65 cycles per minute, under 762 g tension (which corresponded to 1.5% of the break force of the UHMWPE fiber).

The combination of the UHMWPE fiber and the ePTFE monofilament fiber was also tested for abrasion resistance in the same manner. Three complete wraps were applied to the combination of the fibers. The test was conducted at 65 cycles per minute and under 775 g tension (which corresponded to 1.5% of the break force of the fiber combination).

The abrasion tests were run for 500 cycles, after which point the test samples were tensile tested to determine their break force. The composite bundle and the UHMWPE fiber exhibited 42.29 kg and 10.90 kg break forces after abrasion, respectively. Adding the ePTFE monofilament fiber to the UHMWPE fiber increased the post-abrasion break force by 288%. Thus, adding the single ePTFE fiber increased the break force by 2% prior to testing and resulted in a 288% higher break force upon completion of the abrasion test. The abrasion rates for the UHMWPE fiber alone and the composite of the UHMWPE fiber and the ePTFE monofilament fiber were 79.8 g/cycle and 18.8 g/cycle, respectively.

Example 2B

A combination of an ePTFE fiber and an UHMWPE fiber was created and tested as described in Example 2a, except that in this case the ePTFE fiber was a multifilament fiber. A 400 d ePTFE monofilament fiber was towed using a pinwheel to create a multifilament ePTFE fiber. The multifilament fiber possessed the following properties: 405 d weight per unit length, 1.18 kg break force, 2.90 g/d tenacity and 0.72 g/cc density.

One multifilament ePTFE fiber was combined with one UHMWPE fiber as described in Example 2a. The properties and testing results for the UHMWPE fiber are presented in Example 2a. The composite bundle consisted of 80% UHMWPE by weight and 20% ePTFE by weight.

The weight per unit length of the composite bundle was 1986 d. The break force of the composite bundle was 50.35 kg. The tenacity of the composite bundle was 25.4 g/d. Adding the ePTFE fiber to the UHMWPE fiber changed the weight per unit length, break force, and tenacity by +26%, −1%, and −21%, respectively.

The combination of the UHMWPE fiber and the ePTFE multifilament fiber was tested for abrasion resistance under 755 g tension (which corresponded to 1.5% of the break force of the fiber combination) using three full wraps and 65 cycles/min as in Example 2a. The abrasion tests were again run for 500 cycles. The break force after abrasion for the composite ePTFE-UHMWPE bundle was 41.37 kg. Adding the ePTFE multifilament fiber to the UHMWPE fiber increased the post-abrasion break force by 280%. Thus, adding the single ePTFE fiber changed the break force by −1% prior to testing and resulted in a 280% higher break force upon completion of the abrasion test. The abrasion rate for the composite bundle was 18.0 g/cycle.

Example 3

An ePTFE monofilament fiber was combined with a twisted para-aramid fiber (Kevlar® fiber, E.I. DuPont deNemours, Inc., Wilmington, Del.) and subjected to the abrasion test. The results from this test were compared against the results from the test of a single para-aramid fiber.

The ePTFE monofilament fiber was the same as described in Example 1. The properties and testing results for the ePTFE monofilament fiber are presented in Example 1. The para-aramid fiber had a weight per unit length of 2027 d, a 40.36 kg break force, and a tenacity of 19.9 g/d.

The two fiber types were combined as described in Example 1 yielding a composite bundle comprised of 83% para-aramid by weight and 17% ePTFE monofilament by weight. The weight per unit length of the composite bundle was 2452 d. The break force of the composite bundle was 40.41 kg. The tenacity of the composite bundle was 16.7 g/d. Adding the single ePTFE fiber to the para-aramid changed the weight per unit length, break force, and tenacity by +21%, +0%, and −16%, respectively.

A single para-aramid fiber was tested for abrasion resistance following the procedure described previously. It should be noted that due to the twist of the para-aramid fiber, the wrap direction was in the same direction as the inherent twist of the para-aramid fiber, which in this case was the reverse of the other examples. Three complete wraps were applied to the fiber. The test was conducted at 65 cycles per minute, under 605 g tension (which corresponded to 1.5% of the break force of the para-aramid fiber).

The combination of the para-aramid fiber and the ePTFE monofilament fiber was also tested for abrasion resistance in the same manner. Three complete wraps were applied to the combination of the fibers. The test was conducted at 65 cycles per minute and under 606 g tension (which corresponded to 1.5% of the break force of the fiber combination).

The abrasion tests were run for 400 cycles, after which point the test samples were tensile tested to determine their break force. The composite bundle and the para-aramid fiber exhibited 17.40 kg and 9.29 kg break forces after abrasion, respectively. Adding the ePTFE monofilament fiber to the para-aramid fiber increased the post-abrasion break force by 87%. Thus, adding the single ePTFE fiber increased the break force by 0% prior to testing and resulted in a 87% higher break force upon completion of the abrasion test. The abrasion rates for the para-aramid fiber alone and the composite of the para-aramid fiber and the ePTFE monofilament fiber were 77.7 g/cycle and 57.5 g/cycle, respectively.

Example 4

A single graphite-filled ePTFE fiber was combined with a single ultra high molecular weight polyethylene (UHMWPE) fiber (Dyneema® fiber) and subjected to the abrasion test. The results from this test were compared against the results from the test of a single UHMWPE fiber.

The graphite-filled ePTFE monofilament fiber was made in accordance with the teachings of U.S. Pat. No. 5,262,234 to Minor, et al. This fiber possessed the following properties: 475 d weight per unit length, 0.98 kg break force, 2.07 g/d tenacity and 0.94 g/cc density. The properties and testing results for the UHMWPE fiber are presented in Example 2a.

The two fiber types were combined in the same manner as in Example 1. The weight percentages of these two fibers when combined were 77% UHMWPE and 23% graphite-filled ePTFE. The weights per unit length of the UHMWPE and the composite bundle were 1581 d and 2056 d, respectively. The break force of the composite bundle was 49.35 kg. The tenacity of the composite bundle was 24.0 g/d. Adding the graphite-filled ePTFE fiber to the UHMWPE fiber changed the weight per unit length, break force, and tenacity by +30%, −3%, and −25%, respectively.

The combination of the UHMWPE fiber and the graphite-filled ePTFE monofilament fiber was tested for abrasion resistance. Three complete wraps were applied to the combination of the fibers. The test was conducted at 65 cycles per minute and under 740 g tension (which corresponded to 1.5% of the break force of the fiber combination). The abrasion testing results for the UHMWPE fiber are presented in Example 2a.

The abrasion tests were run for 500 cycles, after which point the test samples were tensile tested to determine their break force. The composite bundle exhibited a 36.73 kg break force after abrasion. Adding the graphite-filled monofilament ePTFE to the UHMWPE fiber increased the post-abrasion break force by 237%. Thus, adding the ePTFE monofilament fiber changed the break force by −3% prior to testing and resulted in a 237% higher break force upon completion of the abrasion test. The abrasion rates for the single UHMWPE fiber alone and the composite bundle of the single UHMWPE fiber and the single graphite-filled ePTFE monofilament fiber were 79.8 g/cycle and 25.2 g/cycle, respectively.

Example 5

Three different fiber types, UHMWPE, LCP, and ePTFE monofilament fibers, were combined to form a composite bundle. These fibers have the same properties as reported in examples 1 and 2a. The number of strands and weight percent of each fiber type were as follows: 1 and 40% for UHMWPE, 1 and 39% for LCP, and 2 and 21% for ePTFE monofilament.

Tensile and abrasion testing were performed for this composite bundle as well as a composite bundle comprising one strand each of the UHMWPE and LCP fibers. The weights per length, break forces, and tenacities for the 2-fiber type and 3-fiber type configurations were 3148 d and 3998 d, 73.64 kg and 75.09 kg, and 23.4 g/d and 18.8 g/d, respectively.

The abrasion test conditions were the same as previously described except that the test was not terminated when a certain number of cycles was reached, but rather once the sample failed and three (not four) tests were conducted for each configuration. The fibers were placed side-by-side in the abrasion tester in the following manner: the LCP fiber, a PTFE fiber, the UHMWPE fiber, a PTFE fiber with the LCP fiber positioned furthermost from the operator and the PTFE fiber positioned closest to the operator. Failure was defined as total breakage of the composite bundles. For the abrasion test, 4 complete wraps were applied to the composite bundle. The test was conducted at 65 cycles per minute. The applied tension was 1105 g for the composite of UHMWPE and LCP fibers only and was 1126 g for the composite of all three fiber types. The tension in both tests corresponded to 1.5% of the break force of the fiber combination.

The average cycles to failure was calculated from the three abrasion test results. Failure occurred at 1263 cycles for the composite bundle of UHMWPE and LCP fibers only and it occurred at 2761 cycles for the composite bundle of all three fiber types.

Adding the ePTFE monofilament fibers to the combination of one UHMWPE fiber and one LCP fiber changed the weight per unit length, break force, and tenacity by +27%, +2%, and −20%, respectively. The addition of the ePTFE fibers increased the cycles to failure by +119%.

Example 6

Two additional composite bundles were constructed using the methods and fibers as described in Example 2a. These two composite bundles were designed to have two different weight percentages of the ePTFE monofilament and UHMWPE fiber components.

6a)

A single ePTFE fiber was combined with three UHMWPE fibers and subjected to the abrasion test. The weight percentages of the ePTFE fiber and the UHMWPE fibers were 8% and 92%, respectively. The weights per unit length of the three UHMWPE fibers and of the composite bundle were 4743 d and 5168 d, respectively. The break forces of the three UHMWPE fibers and of the composite bundle were 124.44 kg and 120.63 kg, respectively. The tenacities of the three UHMWPE fibers and of the composite bundle were 26.2 g/d and 23.3 g/d, respectively. Adding the ePTFE fiber to the three UHMWPE fibers changed the weight per unit length, break force, and tenacity by +9%, −3%, and −11%, respectively.

For the abrasion test, 2 complete wraps were applied to the test samples. The tests were conducted at 65 cycles per minute and under 1867 g and 1810 g tension, respectively for the three UHMWPE fibers alone and the composite bundle of three UHMWPE fibers and single ePTFE fiber. (These tensions corresponded to 1.5% of the break force of the test samples).

The abrasion tests were conducted for 600 cycles, after which point the test samples were tensile tested to determine their break force. The composite bundle and the three UHMWPE fibers exhibited 99.07 kg and 23.90 kg break forces after abrasion, respectively. Thus, adding the single ePTFE fiber to the three UHMWPE fibers changed the break force by −3%% prior to testing and resulted in a 314% higher break force upon completion of the abrasion test. The abrasion rates for the composite of three UHMWPE fibers without and with the single ePTFE monofilament fiber were 167.6 g/cycle and 35.9 g/cycle, respectively.

6b)

Five ePTFE fibers were combined with three UHMWPE fibers and subjected to the abrasion test. The weight percentages of the ePTFE fibers and the UHMWPE fibers were 31% and 69%, respectively. The weights per unit length of the three UHMWPE fibers and of the composite bundle were 4743 d and 6868 d, respectively. The break forces of the three UHMWPE fibers and of the composite bundle were 124.44 kg and 122.53 kg, respectively. The tenacities of the three UHMWPE fibers and of the composite bundle were 26.2 g/d and 19.0 g/d, respectively. Adding five ePTFE fibers to the three UHMWPE fibers changed the weight per unit length, break force, and tenacity by +45%, −2%, and −27%, respectively.

For the abrasion test, 2 complete wraps were applied to the test samples. The tests were conducted at 65 cycles per minute and under 1867 g and 1838 g tension, respectively for the three UHMXPE fibers alone and the composite of three UHMWPE fibers and fives ePTFE fibers. (These tensions corresponded to 1.5% of the break force of the test samples.

The abrasion tests were conducted for 600 cycles, after which point the test samples were tensile tested to determine their break force. The composite bundle exhibited a 100.49 kg break force after abrasion. Thus, adding the five ePTFE fibers changed the break force by −2% prior to testing and resulted in a 320% higher break force upon completion of the abrasion test. The abrasion rates for the composite of three UHMWPE fibers without and with the five ePTFE monofilament fibers were 167.6 g/cycle and 36.7 g/cycle, respectively.

Example 7

Another composite bundle was constructed using the methods and the UHMWPE fiber as described in Example 2a. In this example a lower density ePTFE monofilament fiber was used. This fiber was produced in accordance with the teachings of U.S. Pat. No. 6,539,951 and possessed the following properties: 973 d weight per unit length, 2.22 kg break force, 2.29 g/d tenacity and 0.51 g/cc density.

Single fibers of both fiber types were combined as described in Example 2. The weight percentages of these two fibers when combined were 62% UHMWPE and 38% ePTFE. The weight per unit length of the composite bundle was 2554 d. The break force of the composite bundle was 49.26 kg. The tenacity of the composite bundle was 19.3 g/d. Adding the single PTFE fiber to the UHMWPE fiber changed the weight per unit length, break force, and tenacity by +62%, −3%, and −40%, respectively.

The test method and results of abrasion testing a single UHMWPE fiber were reported in Example 2a. The composite of the UHMWPE fiber and the low density ePTFE monofilament fiber was also tested for abrasion resistance in the same manner. Three complete wraps were applied to the composite bundle. The test was conducted at 65 cycles per minute and under 739 g tension (which corresponded to 1.5% of the break force of the fiber combination).

The abrasion tests were run for 500 cycles, after which point the test samples were tensile tested to determine their break force. The composite bundle and the UHMWPE fiber exhibited 44.26 kg and 10.9 kg break forces after abrasion, respectively. Thus, adding the single ePTFE fiber changed the break force by −3% prior to testing and resulted in a 306% higher break force upon completion of the abrasion test. The abrasion rates for the UHMWPE fiber alone and the composite bundle of the UHMWPE fiber and the low density ePTFE monofilament fiber were 79.80 g/cycle and 10.00 g/cycle, respectively.

Example 8

Another composite bundle was constructed using the methods and the UHMWPE fiber as described in Example 2. In this Example, matrix-spun PTFE multifilament fiber (E.I. DuPont deNemours, Inc., Wilmington, Del.) was used. This fiber possessed the following properties: 407 d weight per unit length, 0.64 kg break force, 1.59 g/d tenacity and 1.07 g/cc density.

Single fibers of both fiber types were combined as described in Example 2. The weight percentages of these two fibers when combined were 80% UHMWPE and 20% PTFE. The weight per unit length of the composite bundle was 1988 d. The break force of the composite bundle was 49.51 kg. The tenacity of the composite bundle was 24.9 g/d. Adding the single PTFE fiber to the UHMWPE fiber changed the weight per unit length, break force, and tenacity by +26%, −2%, and −22%, respectively.

The test method and results of abrasion testing a single UHMWPE fiber were reported in Example 2a. The composite bundle of the UHMWPE fiber and the PTFE multifilament fiber was also tested for abrasion resistance in the same manner. Three complete wraps were applied to the composite bundle. The test was conducted at 65 cycles per minute and under 743 g tension (which corresponded to 1.5% of the break force of the fiber combination).

The abrasion tests were run for 500 cycles, after which point the test samples were tensile tested to determine their break force. The composite bundle and the UHMWPE fiber exhibited 39.64 kg and 10.9 kg break forces after abrasion, respectively. Thus, adding the single PTFE fiber changed the break force by −2% prior to testing and resulted in a 264% higher break force upon completion of the abrasion test. The abrasion rates for the UHMWPE fiber alone and the composite bundle of the UHMWPE fiber and the PTFE multifilament fiber were 79.80 g/cycle and 19.74 g/cycle, respectively.

Example 9

Another composite bundle was constructed using the methods and the UHMWPE fiber as described in Example 2.

In this Example, an ETFE (ethylene-tetrafluoroethylene) multifilament fluoropolymer fiber (available from E.I. DuPont deNemours, Inc., Wilmington, Del.) was used. This fiber possessed the following properties: 417 d weight per unit length, 1.10 kg break force, 2.64 g/d tenacity and 1.64 g/cc density.

Single fibers of both fiber types were combined as described in Example 2. The weight percentages of these two fibers when combined were 79% UHMWPE and 21% ETFE. The weight per unit length of the composite bundle was 1998 d. The break force of the composite bundle was 50.44 kg. The tenacity of the composite bundle was 25.2 g/d. Adding the single ETFE fiber to the UHMWPE changed the weight per unit length, break force, and tenacity by +26%, −1%, and −21%, respectively.

The test method and results of abrasion testing a single UHMWPE fiber were reported in Example 2a. The composite bundle of the UHMWPE fiber and the ETFE multifilament fluoropolymer fiber was also tested for abrasion resistance in the same manner. Three complete wraps were applied to the composite bundle. The test was conducted at 65 cycles per minute and under 757 g tension (which corresponded to 1.5% of the break force of the fiber combination).

The abrasion tests were run for 500 cycles, after which point the abraded test samples were tensile tested to determine their break force. The composite bundle and the UHMWPE fiber exhibited 27.87 kg and 10.9 kg break forces after abrasion, respectively. Thus, adding the single ETFE multifilament fiber changed the break force by −1% prior to testing and resulted in a 156% higher break force upon completion of the abrasion test. The abrasion rates for the UHMWPE fiber alone and the composite bundle of the UHMWPE fiber and the ETFE multifilament fiber were 79.80 g/cycle and 45.14 g/cycle, respectively.

In summary, the above examples demonstrate certain embodiments of the present invention, specifically:

Examples 1-3 demonstrate the combination of a single ePTFE fiber with a single fiber of each of the three major high strength fibers;

Example 2 also compares monofilament and multifilament ePTFE fibers.

Example 4 demonstrates the effect of combining a graphite-filled ePTFE monofilament fiber with a single UHMWPE fiber.

Example 5 demonstrates the performance of a three-fiber construction, as is used in making a rope; the abrasion test was conducted until failure.

Example 6 demonstrates the effects of varying the amount of monofilament ePTFE fiber in a two-fiber construction (varying the number of ePTFE fibers and combining them with three UHMWPE fibers).

Example 7 demonstrates the effect of using a lower density monofilament ePTFE fiber [to compare with Examples 2a-b and Examples 6a-b].

Example 8 demonstrates the effect of using a low tenacity, non-expanded PTFE fiber with a UHMWPE fiber.

Example 9 demonstrates the use of an alternative fluoropolymer.

These results are summarized in the following tables.

TABLE 1

| | Example | | | | | |
|---|---|---|---|---|---|---|
| | 1 | 2a | 2b | 3 | 4 | 5 |
| Fluoropolymer Component | ePTFE | ePTFE | ePTFE | ePTFE | ePTFE | ePTFE |
| fiber type | mono- | mono- | multi- | mono- | C-filled mono- | mono- |
| # of fibers | 1 | 1 | 1 | 1 | 1 | 2 |
| weight/length (d) | 425 | 425 | 405 | 425 | 475 | 425 |
| density (g/cc) | 1.78 | 1.78 | 0.72 | 1.78 | 0.94 | 1.78 |
| break force (kg) | 2.29 | 2.29 | 1.18 | 2.29 | 0.98 | 2.29 |
| tenacity (g/d) | 5.38 | 5.38 | 2.9 | 5.38 | 2.07 | 5.38 |
| weight percent (%) | 21 | 21 | 20 | 17 | 23 | 21 |
| Component 2 | | | | | | |
| type | LCP | UHMWPE | UHMWPE | para-aramid | UHMWPE | LCP |
| # of fibers | 1 | 1 | 1 | 1 | 1 | 1 |
| weight/length (d) | 1567 | 1581 | 1581 | 2027 | 1581 | 1567 |
| break force (kg) | 34.55 | 50.8 | 50.8 | 40.36 | 50.8 | 34.55 |
| tenacity (g/d) | 22 | 32.1 | 32.1 | 19.9 | 32.1 | 22 |
| weight percent (%) | 79 | 79 | 80 | 83 | 77 | 39 |
| Component 3 | | | | | | |
| Type | x | x | x | x | x | UHMWPE |
| # of fibers | x | x | x | x | x | 1 |
| weight/length (d) | x | x | x | x | x | 1581 |
| break force (kg) | x | x | x | x | x | 50.8 |
| tenacity (g/d) | x | x | x | x | x | 32.1 |
| weight percent (%) | x | x | x | x | x | 40 |
| Composite | | | | | | |
| weight/length (d) | 1992 | 2006 | 1986 | 2452 | 2056 | 3998 |
| break force (kg) | 33.87 | 51.67 | 50.35 | 40.41 | 49.35 | 75.09 |
| tenacity (g/d) | 17 | 25.7 | 25.4 | 16.7 | 24 | 18.8 |

TABLE 1-continued

| | Example | | | | |
|---|---|---|---|---|---|
| | 6a | 6b | 7 | 8 | 9 |
| Fluoropolymer Component | ePTFE | ePTFE | ePTFE | matrix-spun PTFE | ETFE |
| fiber type | mono- | mono- | mono- | multi- | multi- |
| # of fibers | 1 | 5 | 1 | 1 | 1 |
| weight/length (d) | 425 | 425 | 973 | 407 | 417 |
| density (g/cc) | 1.78 | 1.78 | 0.51 | 1.07 | 1.64 |
| break force (kg) | 2.29 | 2.29 | 2.22 | 0.64 | 1.10 |
| tenacity (g/d) | 5.38 | 5.38 | 2.29 | 1.59 | 2.64 |
| weight percent (%) | 8 | 31 | 38 | 20 | 21 |
| Component 2 | | | | | |
| type | UHMWPE | UHMWPE | UHMWPE | UHMWPE | UHMWPE |
| # of fibers | 3 | 3 | 1 | 1 | 1 |
| weight/length (d) | 4743 | 4743 | 1581 | 1581 | 1581 |
| break force (kg) | 124.44 | 124.44 | 50.8 | 50.8 | 50.8 |
| tenacity (g/d) | 26.2 | 26.2 | 32.1 | 32.1 | 32.1 |
| weight percent (%) | 92 | 69 | 62 | 80 | 79 |
| Component 3 | | | | | |
| Type | x | x | x | x | x |
| # of fibers | x | x | x | x | x |
| weight/length (d) | x | x | x | x | x |
| break force (kg) | x | x | x | x | x |
| tenacity (g/d) | x | x | x | x | x |
| weight percent (%) | x | x | x | x | x |
| Composite | | | | | |
| weight/length (d) | 5168 | 6868 | 2554 | 1988 | 1998 |
| break force (kg) | 120.63 | 122.53 | 49.26 | 49.51 | 50.44 |
| tenacity (g/d) | 23.3 | 19 | 19.3 | 24.9 | 25.2 |

TABLE 2

| | | | | tension (g) (1.5% of the break force) | | | |
|---|---|---|---|---|---|---|---|
| Example | Composition (weight %, fiber type) | Construction (number of fibers) | rate (cycles/min) | non-ePTFE component | composite | number of twists | cycles |
| 1 | 21% monofilament ePTFE, 79% LCP | 1 PTFE/1 LCP | 100 | 518 | 508 | 5 | 1500 |
| 2a | 21% monofilament ePTFE, 79% UHMWPE | 1 PTFE/1 UHMWPE | 65 | 762 | 775 | 3 | 500 |
| 2b | 20% multifilament ePTFE, 80% UHMWPE | 1 PTFE/1 UHMWPE | 65 | 762 | 755 | 3 | 500 |
| 3 | 17% monofilament ePTFE, 83% para-aramid | 1 PTFE/1 para-aramid | 65 | 605 | 606 | 3 | 400 |
| 4 | 23% C-filled monofilament ePTFE, 77% UHMWPE | 1 PTFE/1 UHMWPE | 65 | 762 | 740 | 3 | 500 |
| 5 | 21% monofilament ePTFE, 39% LCP, 40% UHMWPE | 2 PTFE/1 LCP/ 1 UHMWPE | 65 | 1105 | 1126 | 4 | to failure |
| 6a | 8% monofilament ePTFE, 92% UHMWPE | 1 PTFE/3 UHMWPE | 65 | 1867 | 1810 | 2 | 600 |
| 6b | 31% monofilament ePTFE, 69% UHMWPE | 5 PTFE/3 UHMWPE | 65 | 1867 | 1838 | 2 | 600 |
| 7 | 38% low density monofilament ePTFE, 62% UHMWPE | 1 PTFE/1 UHMWPE | 65 | 762 | 739 | 3 | 500 |
| 8 | 20% matrix-spun PTFE, 80% UHMWPE | 1 PTFE/1 UHMWPE | 65 | 762 | 743 | 3 | 500 |
| 9 | 21% ETFE, 79% UHMWPE | 1 ETFE/1 UHMWPE | 65 | 762 | 757 | 3 | 500 |

TABLE 3

| | | Break Strength after Abrasion Test (kg) | | Ratio of Break Strengths | Abrasion Rate (g/cycle) | | Ratio of Abrasion Rates |
|---|---|---|---|---|---|---|---|
| Example | Composition (weight %, fiber type) | Inventive Article | Prior Art (no PTFE) | after Abrasion Test (inventive:prior art) | Inventive Article | Prior Art (no PTFE) | (prior art: inventive) |
| 1 | 21% monofilament ePTFE, 79% LCP | 26.38 | 13.21 | 2.00 | 5.00 | 14.20 | 2.84 |
| 2a | 21% monofilament ePTFE, 79% UHMWPE | 42.29 | 10.90 | 3.88 | 18.80 | 79.80 | 4.24 |
| 2b | 20% multifilament ePTFE, 80% UHMWPE | 41.37 | 10.90 | 3.80 | 18.00 | 79.80 | 4.43 |
| 3 | 17% monofilament ePTFE, 83% para-aramid | 17.40 | 9.29 | 1.87 | 57.50 | 77.70 | 1.35 |
| 4 | 23% C-filled monofilament ePTFE, 77% UHMWPE | 36.73 | 10.90 | 3.37 | 25.20 | 79.80 | 3.17 |

TABLE 3-continued

| Example | Composition (weight %, fiber type) | Break Strength after Abrasion Test (kg) | | Ratio of Break Strengths | Abrasion Rate (g/cycle) | | Ratio of Abrasion Rates |
|---|---|---|---|---|---|---|---|
| | | Inventive Article | Prior Art (no PTFE) | after Abrasion Test (inventive:prior art) | Inventive Article | Prior Art (no PTFE) | (prior art: inventive) |
| 5 | 21% monofilament ePTFE, 39% LCP, 40% UHMWPE | n/a | n/a | n/a | n/a | n/a | n/a |
| 6a | 8% monofilament ePTFE, 92% UHMWPE | 99.07 | 23.90 | 4.14 | 35.90 | 167.60 | 4.67 |
| 6b | 31% monofilament ePTFE, 69% UHMWPE | 100.49 | 23.90 | 4.20 | 36.70 | 167.60 | 4.57 |
| 7 | 38% monofilament ePTFE, 62% UHMWPE | 44.26 | 10.90 | 4.06 | 10.00 | 79.80 | 7.98 |
| 8 | 20% matrix-spun PTFE, 80% UHMWPE | 39.64 | 10.90 | 3.64 | 19.74 | 79.80 | 4.04 |
| 9 | 21% ETFE, 79% UHMWPE | 27.87 | 10.90 | 2.56 | 45.14 | 79.80 | 1.77 |

Comparative Example 1

Twaron Control, Lay Rope

Figure 5:
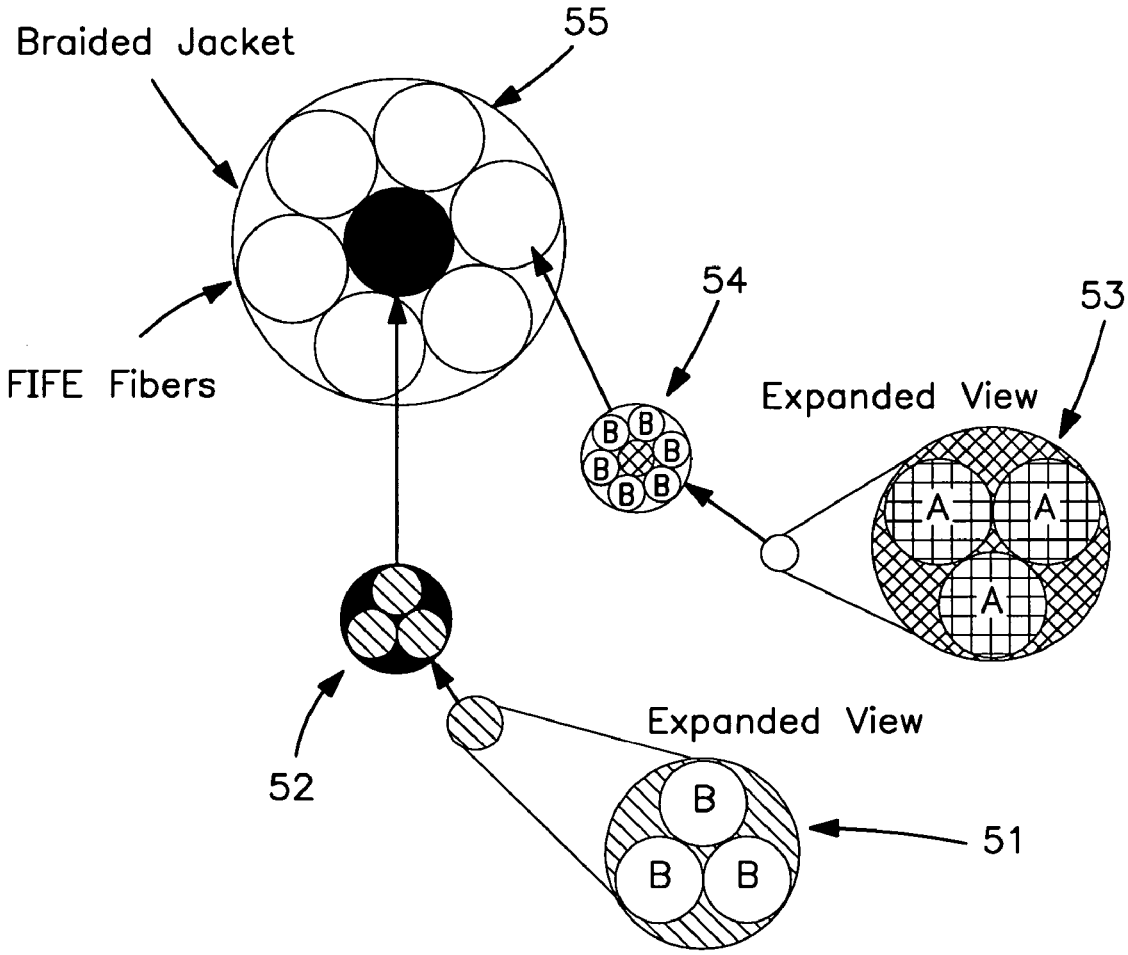
FIG. 5 is a schematic cross-section of a rope made according to an exemplary embodiment of the present invention.

The ropes were made using a 6×9 wire-rope construction with a load bearing core. The cross section of the rope is shown in FIG. 5. The outer diameter of the ropes was 0.75 in. The break strength of this rope is approximately 48300 lbs. The ropes were assembled from Twaron type 1000, denier of 3024, and 2000 filaments (Teijin Twaron Westervoortsedijk 73 P.O. Box 9600, 6800 TC Arnhem, The Netherlands).

Two fundamental bundle groups were used to assemble the ropes. Bundle groups labeled type A in FIG. 5 were comprised of 6 twaron bundles pulled together. Bundle groups labeled type B in FIG. 5 were comprised of 9 twaron bundles pulled together.

The "rope core bundle groups", labeled 51 in FIG. 5, were helically laid together from three type B bundle groups. The rope core bundle group labeled 52 in FIG. 5 was then assembled by helically laying the three rope core bundle groups together.

The "outer bundle groups", labeled 53 in FIG. 5, were helically laid together from three type A strands. Outer bundle groups, labeled 54 in FIG. 5, were then assembled by helically laying or closing 6 type B bundle groups around the core.

The rope labeled 55 in FIG. 5 was then assembled by helically laying or closing the outer bundle groups around the rope core bundle group. The assembled rope was then enclosed by a braided polyester jacket.

The assembled rope bundle groups and rope core outer bundle group are regular lay. The bundles and the bundle core are lang lay.

The rope prepared as above was then tested using the following test and conditions: Bend over sheave test, 25% breaking load (12000 lbs) of the control rope, 500 cycles/hour, 1.1 ft/sec rope speed, 4 ft stroke length, and D:d of 20.

Two rope specimens were cycled to failure, 2787 and 3200 machine cycles respectively. A section of the rope called the double bend zone went on and off of the sheave twice during one machine cycle.

Comparative Example 2

Twaron Lay Rope with PTFE Homogeneously Dispersed

Rope 2*a* was prepared as in Comparative Example 1 with the addition of commercially available 500 denier PTFE fibers with a tenacity of 5.1 g/den and density of 2 g/cc. (W.L. Gore & Associates. Inc., Newark Del.). Rope 2*b* was prepared as in comparative example 1 with the addition of 250 denier PTFE fiber with a tenacity of 5.9 g/den and a density of 1.9 g/cc.

In Comparative example 2a, two fundamental bundle groups were used to assemble the ropes. Bundle groups labeled type A in FIG. 1 were comprised of 5 twaron yarns and 500 denier PTFE fibers pulled together such that the PTFE was homogenously distributed. Bundle groups labeled type B in FIG. 5 were comprised of 8 twaron bundles and eight 500 denier PTFE fibers pulled together such that the PTFE was homogenously distributed. Two rope specimens were cycled to failure.

In Comparative example 2b, two fundamental bundle groups were used to assemble the ropes. Bundle groups labeled type A in FIG. 5 were comprised of 5 twaron yarns and sixteen 250 denier PTFE fibers pulled together in a bundle such that the PTFE was homogenously distributed. Bundle groups labeled type B in FIG. 5 were comprised of 8 twaron bundles and sixteen 250 denier PTFE fibers pulled together such that the PTFE was homogenously distributed. Two rope specimens were cycled to failure.

The rope prepared as above was then tested using the following test and conditions: Bend over sheave test, 25% breaking load (12000 lbs) of the control rope, 500 cycles/hour, 1.1 ft/sec rope speed, 4 ft stroke length, and D:d of 20.

TABLE 1

| Comparative Example | Fluoropolymer fiber | Denier (g/9000 M) | Tenacity (g/denier) | Machine cycles to failure |
|---|---|---|---|---|
| 2a | PTFE | 500 | 5.1 | 2468<br>3192 |
| 2b | PTFE | 250 | 5.9 | 3267<br>3746 |

Example 10

Twaron Lay Rope with PTFE Periphery

Ropes were prepared as in Comparative Example 1 with two exceptions. One twaron bundle was omitted from each fundamental bundle groups A and B. Prior to final assembly of the rope PTFE fibers were laid or closed around the outside of the rope core bundle group and outer bundle group. To accomplish this six 500 denier (3a) or twelve 250 denier (3b) PTFE fibers were wound with one 1500 Denier Kevlar 39 yarn onto bobbins. The PTFE fibers and carrier Kevlar (Dupont, 5401 Jefferson Davis Highway, Richmond, Va. 23234 ) were then helically laid around the outside of the respective outer bundle group or core bundle group with a 1 inch lay length. The PTFE fiber was laid in the same direction around both the outer and the core.

Rope 10*a* was prepared with the addition of PTFE fiber with a denier of 500 g/9000 m and a tenacity of 5.1 g/den, and a density of 2 g/cc. Two rope specimens were tested to failure.

Rope 10*b* was prepared with the addition of PTFE fiber with a denier of 250 g/9000 m and a tenacity of 5.9 g/den, and a density of 1.9 g/cc. Two rope specimens were tested to failure.

Rope 10*c* was prepared with the addition of PTFE fiber with a denier of 250 g/9000 m and a tenacity of 3.1 g/den, and a density of 1.6 g/cc. Two rope specimens were tested to failure.

The rope prepared as above was then tested using the following test and conditions: Bend over sheave test, 25% breaking load (12000 lbs) of the control rope, 500 cycles/hour; 1.1 ft/sec rope speed, 4 ft stroke length, and D:d of 20.

TABLE 2

| Example | Fluoropolymer fiber | Denier (g/9000 M) | Tenacity (g/denier) | Machine cycles to failure |
|---|---|---|---|---|
| 10a | PTFE | 500 | 5.1 | 9562 |
| | | | | 8856 |
| 10b | PTFE | 250 | 5.9 | 9457 |
| | | | | 10162 |
| 10c | PTFE | 250 | 3.1 | 8333 |
| | | | | 9824 |

Comparative Example 3

Vectran Control Braid

Ropes were prepared from 12 equivalent bundle groups of one hundred and twenty 1500 denier Vectran T97 bundles (Kurary America Inc., 101 East 52nd Street, 26th Floor, New York, N.Y. 10022). Bundle groups were assembled by paying off the vectran bundles from a creel to the first 120 holes from the center of a 237 hole holly board shown in FIG. 6. Six bundle groups were twisted in the S and six bundle groups were twisted in the Z direction. These 12 bundle groups were then braided on a 12 bundle group braider in a 2/2 regular braid at 1.18 picks/inch. The outer diameter of the finished rope measured under 100 lbs of reference tension was approximately 0.75 inches. The average break strength of the finished control ropes was 84,500 lbs.

The rope prepared as above was then tested using the following test and conditions:

Bend over sheave test, 18% breaking load (15,210 lbs) of the control rope, 500 cycles/hour, 1.1 ft/sec rope speed, 4 ft stroke length, and D:d of 20. Two rope specimens were cycled to failure, 1001 and 960 cycles respectively. A section of the rope called the double bend zone went on and off of the sheave twice during one machine cycle.

Comparative Example 4

Braid Rope with PTFE Homogenously Distributed

Ropes were prepared as in Comparative Example 3 with the addition of PTFE fibers as described in table 3. For this example only one hundred and two vectran yarns were used with fifty four 500 denier or one hundred and eight 250 denier PTFE fibers. The PTFE fibers and vectran bundles were alternated around the circumference of a given ring of holes in the holly board. In Comparative example 4a, the 500 denier PTFE fibers were alternated to fill every third hole in the sequence vectran yarn, vectran yarn, PTFE fiber. Two ropes were tested. In Comparative examples 4b and 4c, 250 denier fibers were alternated with the vectran yarns to fill every other hole in the holly board. One rope of type 4b was tested and two ropes of 4c were tested. The outer diameters of the finished ropes measured under 100 lbs of reference tension were approximately 0.75 inches.

The ropes prepared as above were then tested using the following test and conditions:

Bend over sheave test, 18% breaking load (15,210 lbs) of the control rope, 500 cycles/hour, 1.1 ft/sec rope speed, 4 ft stroke length, and D:d of 20.

TABLE 3

| Comparative Example | Fluoropolymer fiber | Denier (g/9000 M) | Tenacity (g/denier) | Machine cycles to failure |
|---|---|---|---|---|
| 4a | PTFE | 500 | 5.1 | 24297 |
| | | | | 26862 |
| 4b | PTFE | 250 | 5.9 | 24330 |
| 4c | PTFE | 250 | 3.1 | 1859 |
| | | | | 2213 |

Example 11

Braid Rope with PTFE Periphery

Ropes were prepared as in Comparative Example 4 with the addition of PTFE fibers as described in table 4. For this example only 102 vectran bundles were used with fifty four 500 denier or one hundred and eight 250 denier PTFE fibers. The inner 93 holes of the holly board were filled with vectran yarns. The remaining 9 vectran bundles were evenly dispersed in the next ring of holes. The empty holes in this ring and the next outer rings were threaded with one PTFE fiber per hole until all of the PTFE fibers were used. The outer diameters of the finished ropes measured under 100 lbs of reference tension were approximately 0.75 inches.

The ropes prepared as above were then tested using the following test and conditions:

Bend over sheave test, 18% breaking load (15,210 lbs) of the control rope, 500 cycles/hour, 1.1 ft/sec rope speed, 4 ft stroke length, and D:d of 20.

TABLE 4

| Example | Fluoropolymer fiber | Denier (g/9000 M) | Tenacity (g/denier) | Machine cycles to failure |
|---|---|---|---|---|
| 11 | PTFE | 500 | 5.1 | 105231 |

As can be seen from the tables above, addition of the low coefficient of friction fiber around the periphery of a bundle group of a rope significantly increases rope life. The drastic increase in life due to positioning of the fiber is quite surprising.

While particular embodiments of the present invention have been illustrated and described herein, the present invention should not be limited to such illustrations and descriptions. It should be apparent that changes and modifications may be incorporated and embodied as part of the present invention within the scope of the following claims. In particular, although primarily presented in the exemplary embodiment of a rope for use in repeated stress applications, the inventive composite bundles also have applicability in other forms; for example, in belts, nets, slings, cables, woven fabrics, nonwoven fabrics, and tubular textiles.

The invention claimed is:

1. A rope comprising a. a plurality of bundle groups, each of said bundle groups having a periphery and comprising a plurality of high strength fibers, b. at least one low coefficient of friction fiber disposed around at least a portion of said periphery of at least one of said bundle groups directly contacting a portion of said high strength fibers, wherein said low coefficient of friction fiber comprises expanded polytetrafluoroethylene, c. wherein said rope is a repeated stress application rope.

2. A rope as defined in claim 1 further comprising a plurality of said low coefficient of friction fibers, said low coefficient of friction fibers disposed around at least a portion of said periphery of a plurality of said bundle groups.

3. A rope as defined in claim 1 wherein said high strength fibers comprise ultra high molecular weight polyethylene.

4. A rope as defined in claim 1 wherein said high strength fibers comprise liquid crystal polymers.

5. A rope as defined in claim 1 wherein said high strength fibers comprise para-aramid.

6. A rope as defined in claim 1 further comprising an abrasion resistant coating.

7. A rope as defined in claim 1 used in a deep sea hardware delivery system.

8. A bundle group for use in a rope for a repeated stress application comprising a periphery and comprising a plurality of high strength fibers and at least one low coefficient of friction fiber disposed around at least a portion of said periphery of said bundle group directly contacting at least one of said high strength fibers, wherein said low coefficient of friction fiber comprises expanded polytetrafluoroethylene.

9. A bundle for use in a rope for a repeated stress application comprising a periphery and comprising a plurality of high strength fibers and at least one low coefficient of friction fiber disposed around at least a portion of said periphery of said bundle, wherein said low coefficient of friction fiber comprises expanded polytetrafluoroethylene.

10. A method of making a rope having a plurality of bundle groups comprising the steps of 1) providing for each bundle group a plurality of high strength fibers, and 2) disposing around at least one of said bundle groups a low coefficient of friction fiber directly contacting at least one of said high strength fibers, wherein said low coefficient of friction fiber comprises expanded polytetrafluoroethylene.

* * * * *